US005641300A

United States Patent [19]

Corrion

[11] Patent Number: 5,641,300

[45] Date of Patent: Jun. 24, 1997

[54] LOCKING CONNECTOR WITH LATCH

[75] Inventor: Wesley Richard Corrion, Fenton, Mich.

[73] Assignee: Yazaki Corporation, Tokyo, Japan

[21] Appl. No.: 505,060

[22] Filed: Jul. 21, 1995

[51] Int. Cl.[6] ..... H01R 13/627

[52] U.S. Cl. ..... 439/352

[58] Field of Search ..... 439/352, 353, 439/354, 355, 357, 372, 489, 752, 596

[56] References Cited

U.S. PATENT DOCUMENTS

| | | | |
|---|---|---|---|
| 4,950,179 | 8/1990 | Takenouchi et al. | 439/352 |
| 4,984,998 | 1/1991 | Duncan et al. | 439/752 |
| 5,066,244 | 11/1991 | Kato et al. | 439/489 |
| 5,203,718 | 4/1993 | Chishima | 439/489 |
| 5,382,171 | 1/1995 | Hofmann et al. | 439/142 |
| 5,385,491 | 1/1995 | Fry | 439/595 |
| 5,403,211 | 4/1995 | Sayer et al. | 439/752 |
| 5,425,653 | 6/1995 | Koiso | 439/347 |

FOREIGN PATENT DOCUMENTS

| | | |
|---|---|---|
| 250981 | 4/1990 | Japan . |
| 43413 | 2/1992 | Japan . |
| 7192808 | 7/1995 | Japan . |
| 7192807 | 7/1995 | Japan . |

*Primary Examiner*—P. Austin Bradley
*Assistant Examiner*—Yong Kim
*Attorney, Agent, or Firm*—Young & Basile, P.C.

[57] ABSTRACT

An electrical connector for wiring harnesses and other electrical devices has a lock member to hold the connector in engagement with a mating connector and a latch to guard against inadvertent release of the lock member. The latch is connected by means of a living hinge to a terminal retainer holding a plurality of terminals within the connector and is movable by a worker between a latched position inhibiting movement of the lock member to an unlocked condition and an unlatched position offering no obstruction to movement of the lock member. When in the latched position the latch also serves to prevent wires or other foreign objects from becoming entangled with the lock member during shipping and handling.

13 Claims, 2 Drawing Sheets

LOCKING CONNECTOR WITH LATCH

BACKGROUND OF THE INVENTION

Electrical connectors are widely used in the automotive industry to detachably interconnect and provide electrical continuity between wiring harnesses and various other electrical components. A representative electrical connector comprises a plurality of electrical terminals or contacts held by a nonconductive connector body, with the body adapted to physically engage a mating connector to place the terminals in electrical contact with corresponding terminals of the mating connector. It is common for such mating pairs of connectors to include some form of locking means whereby they may be secured in engagement with one another once in a properly mated relationship. Such locking means serve to ensure that the connector pairs stay positively mated during use and are not inadvertently disconnected by, for example, vibration or incidental contact with other objects during use or maintenance.

It is sometimes necessary, for example in the course of the repair or replacement of a defective component, to intentionally disconnect an electrical connector from its mating connector. For this reason it is necessary to provide a locking means which may be disengaged or otherwise overcome by a worker when desired, and in the interests of speed and simplicity it is advantageous if this can be accomplished without the use of any tools. Hence, many prior electrical connector designs have featured locking means that are biased, as by a spring or the equivalent, to lockingly engage the mating connector when the two connectors are fully mated, and that may be unlocked by hand, i.e. by squeezing or pressing on the connector or some portion thereof with one's fingers to overcome the biasing force, to permit disengagement of the connectors.

It should be apparent that in the design of lockable connectors a trade-off exists in regards to ease of intentional unlocking by a worker on the one hand and resistance to inadvertent unlocking on the other. To be easily manually unlocked by a worker, the portion of the connector that is actuated should be (a) relatively large with respect to the size of the average worker's fingertips, (b) located and configured to provide unobstructed access by the worker, and (c) actuatable with a minimum of effort. These same features, however, increase the likelihood that the connector may be inadvertently unlocked during operational use or shipping.

One prior lockable connector design features a locking arm attached at one end to the exterior surface of the connector and extending in a cantilever fashion substantially parallel with the surface. In its normally biased condition the locking arm, due to its inherent stiffness or to a separate spring, stands away from the connector surface by a small amount. In this position, detent means on the locking arm is in locked engagement with cooperating detent means on the mating connector when the two connectors are properly joined. To release the detent means of the two connectors from locked engagement with one another the locking arm is depressed, forcing it toward the connector surface. Although quite easily and quickly releasable by a worker, it is also possible for such a locking arm to be depressed inadvertently in its operating environment where other objects may press or rub against it.

In order to decrease the likelihood of the locking arm being inadvertently depressed, the connector described above has been modified to include small fins or blocks that extend from the connector surface in close proximity to either side of the free end of the locking arm. These side guards extend upward at least to the level of the highest point of the locking arm, thereby obstructing access to the arm so that an object must fit between the side guards in order to depress the locking arm. For ease of actuation by a worker, the side guards must be spaced far enough apart for an average sized adult worker's fingertip to fit therebetween and press down on the locking arm. Spacing the side guards widely enough for comfortable actuation of the locking arm by a worker, though, can make the locking arm too susceptible to inadvertent actuation.

It has also been found that an electrical connector featuring a locking arm as described above may be damaged during shipping. Electrical connectors are commonly assembled as part of a wiring harness, and one or more harnesses are then packed loosely in a carton for shipping to a location where subsequent component assembly takes place. The vibration and jostling that occurs during shipping and handling of the carton can cause the wires that make up the harnesses to work their way underneath the locking arm, into the gap between the connector body and the arm. If a connector becomes snagged on the harness wiring in this fashion, the locking arm may break off of the connector or be otherwise damaged when the harnesses are pulled out of the carton.

Therefore, it would be desirable to provide a means by which the locking arm of a lockable connector as described above is guarded against being inadvertently depressed and also against snagging on wires or other objects.

SUMMARY OF THE INVENTION

The present invention is directed toward an electrical connector for releasably locking a plurality of terminals in electrical contact with respective terminals of a mating connector, wherein the electrical connector includes a latch to maintain the connectors in locking engagement with one another.

According to the invention, the latch is connected to a detachable retaining means securing the terminals within the electrical connector and is movable between a first latched position wherein it inhibits the release of a locking means and a second unlatched position wherein it permits such release. By positively maintaining the locking means in its locked condition the latch inhibits inadvertent separation of the two connectors and loss of electrical continuity between their respective terminals.

According to a further feature of the invention, the latch and the retaining means are connected by a hinge which permits movement of the latch between its latched and unlatched positions. This method of connecting the two components provides a latching mechanism that may be conveniently and simply operated by a worker without the need for any tools.

According to another feature of the invention, the latch member, hinge, and retaining means are fabricated as an integral unit and the hinge takes the form of a living hinge. This one-piece construction provides for a reduction in the number of pieces required to produce the invention connector with a consequent reduction in assembly costs, as well as providing for the economical manufacture of the piece, particularly in an injection molding process.

In a preferred embodiment of the invention the locking means of the electrical connector comprises a locking member or arm which in its locked condition stands away from an outer surface of the connector and is moved to its unlocked condition by forcing it toward the connector surface, and the latch member comprises blocking means which in its latched position is interposed between the locking member and the connector surface. The blocking means is thus positioned in the path of movement of the locking member so it can not be moved to its unlocked condition.

According to another feature of the invention, the latch member when in its latched position covers the locking member in a manner to substantially prevent the application of pressure thereto as is necessary to move it to the unlocked condition, thus providing a second means to prevent movement of the locking member.

DETAILED DESCRIPTION OF THE PREFERRED EMBODIMENT

Figure 1:
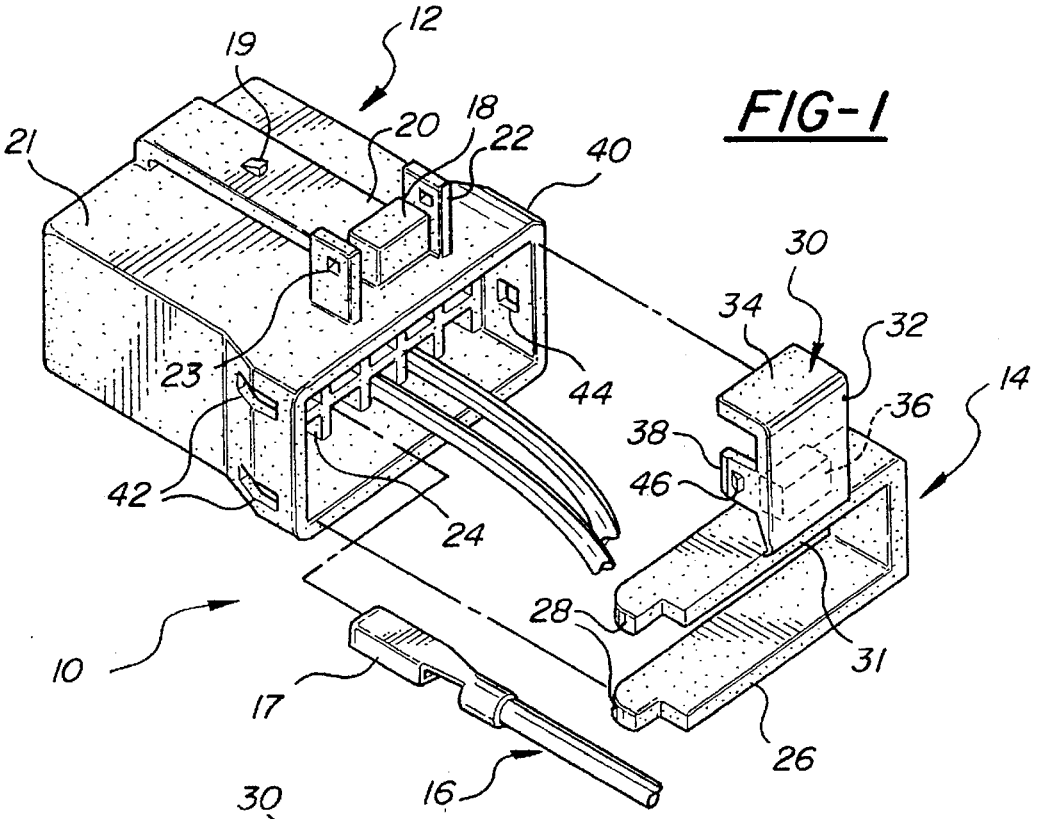
FIG. 1 is an exploded perspective view of an electrical connector assembly according to the present invention.

As shown in FIG. 1, an electrical connector assembly 10 according to the present invention includes a connector 12, a rear holder 14, and a plurality of wires 16. Connector 12 and rear holder 14 are both preferably injection molded from a high-impact thermoplastic material such as nylon or polybutylteraethylene (PBT). Wires 16 are conventional insulated electrical conductors with crimped-on terminals 17.

Connector 12 comprises a body 21 adapted to receive wires 16 internally, a locking arm 20 connected to body 21 adjacent one end and extending substantially parallel to the outer surface of the body, and a pair of side guards 22 projecting substantially perpendicularly upward from the surface of body 21 on opposite sides of locking arm 20 adjacent its free end.

The end of body 21 which receives wires 16 is widened to form a bell 40 with a pair of slots 42 formed in one side of the bell and a hole 44 located at the opposite side. The interior of body 21 is divided into a plurality of terminal receptacles 24 communicating between bell 40 and the opposite end of the body.

The free end of locking arm 20 is enlarged to form a push button 18, and a lock pawl 19 projects upward from the arm at approximately midlength. Locking arm 20 is sufficiently rigid to maintain its position spaced away from body 21 unless forced downward by pressure applied to its surface. Side guards 22 each have a tab hole 23 formed therein.

Figure 2:
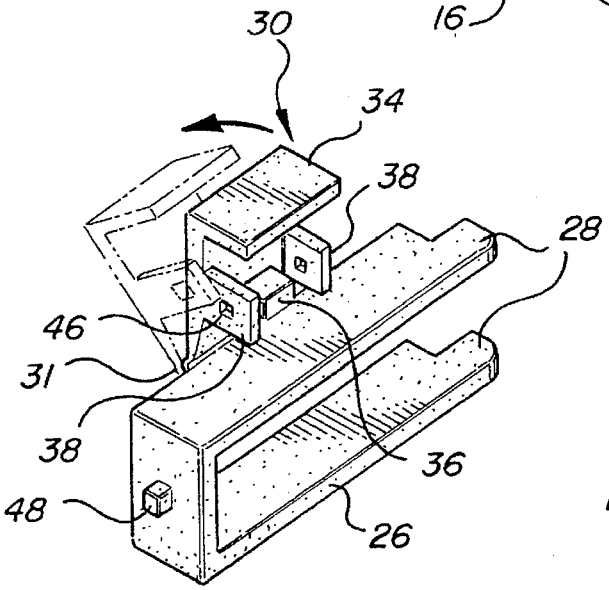
FIG. 2 is a perspective view of a rear holder according to the present invention.

Rear holder 14, also shown in FIG. 2, comprises a substantially U-shaped terminal retainer 26 and a latch 30, with the two portions being integrally molded and connected by a living hinge 31. Living hinge 31 is a section of material at the interface between the two portions that is of reduced thickness and so is sufficiently flexible to permit relative bending movement.

Latch 30 comprises a spine 32, the lower end of which constitutes living hinge 31, and a top guard 34, a blocking post 36 and a pair of detent wings 38 all project substantially perpendicularly therefrom. A detent tab 46 is formed on the outer face of each detent wing 38. Terminal retainer 26 has a finger 28 formed at the end of each arm of the U, and a snap tab 48 projects from the outside of the bight of the U.

Figure 4:
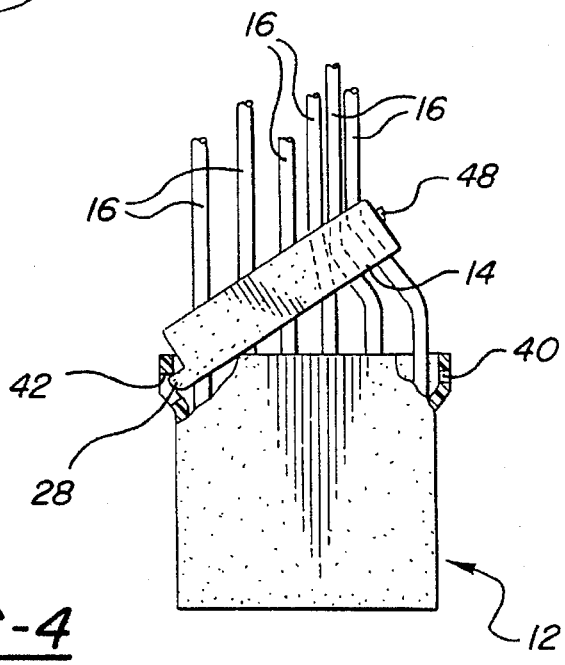
FIG. 4 is a bottom view of the invention electrical connector with the rear holder partially installed therein.
Figure 3:
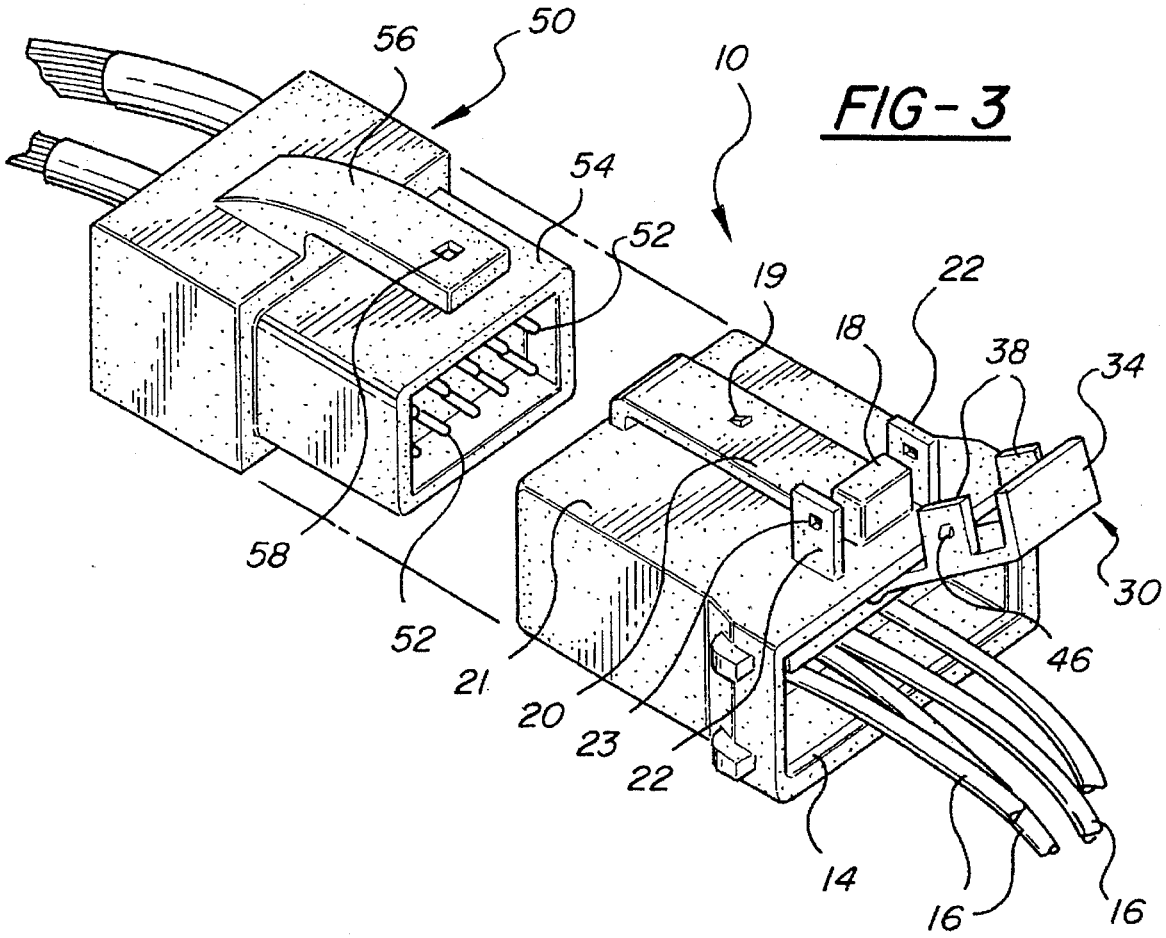
FIG. 3 is a perspective view of the electrical connector of the present invention and a mating connector.

To assemble the components into the condition shown in FIG. 3, wires 16 are inserted into connector body 21 to place terminals 17 in respective terminal receptacles 24, and the terminal retainer portion 26 of rear holder 14 is then snapped into place within bell 40 of connector 12 to secure the terminals in position. The latter step is achieved as shown in FIG. 4, by angling terminal retainer 26 to insert fingers 28 into slots 42 and then pushing the terminal retainer into bell 40 until snap tab 48 engages hole 44.

Referring to FIG. 3, electrical connector 10 is shown aligned with a male connector 50 as the two connectors would be immediately prior to being brought together into mating contact. Male connector 50 comprises an insert shroud 54 enclosing a plurality of contact pins 52 and sized to fit inside of connector body 21, and a locking tab 56. As insert shroud 54 is inserted into the end of electrical connector 10 to bring contact pins 52 into electrical contact with terminals 17, locking tab 54 slides over the top surface of locking arm 20.

Figure 5:
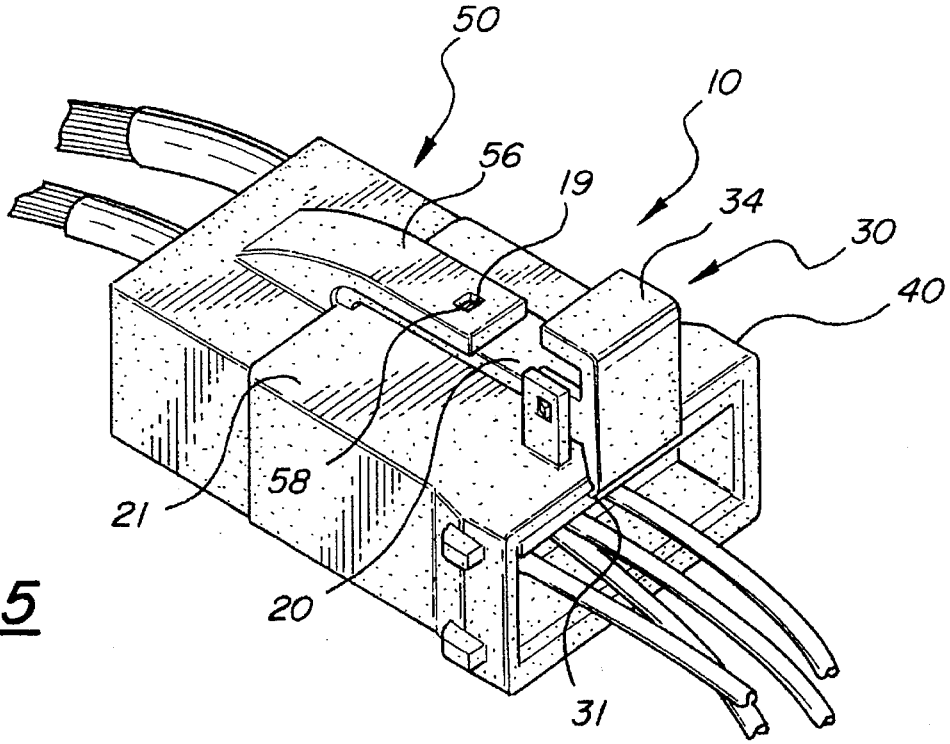
FIG. 5 is a perspective view of the invention electrical connector and its mating connector fully engaged with one another.

When electrical connector 10 and mating connector 50 are fully mated with one another, as shown in FIG. 5, lock pawl 19 of locking arm 20 comes into alignment with and snaps into a hole 58 in locking tab 56. In this condition, the two connectors are held in locked engagement and will effectively resist being separated until downward pressure is applied to push button 18 to disengage lock pawl 19 from hole 58.

To prevent the inadvertent depression of push button 18 and consequent unlocking of the connectors, latch 30 is rotated about living hinge 31 to the latched position shown in FIG. 5. In the latched position, blocking post 36 is inserted between the bottom of push button 18 and the upper surface of bell 40 so that locking arm 20 is effectively prevented from moving downward an amount sufficient to disengage lock pawl 19 from hole 58. Top guard 34 also protects against inadvertent unlocking by covering the top of push button 18 and so preventing any application of pressure thereto that would tend to force it downward.

When in the latched position, latch 30 also serves to prevent wires or other objects from working their way into the gap between locking arm 20 and connector body 21 by substantially surrounding the free end of the locking arm.

When latch 30 is in the latched position, detent wings 38 fit between respective side guards 22 and push button 18 so that detent tabs 46 engage tab holes 23 to retain latch 30 in the latched position unless it is positively forced away therefrom, as by a worker pulling back on top guard 34.

By forming latch 30 integrally with terminal retainer 26, a very convenient and efficient means is provided to guard against the inadvertent depression of locking arm 20 and against the intrusion of foreign objects underneath the locking arm. Some existing connector designs already include substantially all of the features described herein except for latch 30, and so for such connectors the only change required to implement the present invention is to replace the existing terminal retainer with a new one having an attached latch 30. Thus, a latching capability may be added to existing lockable connectors without the capital expenditure that would otherwise be required to design and manufacture tooling for an entirely new connector.

It will be appreciated that the drawings and descriptions contained herein are merely meant to illustrate a particular embodiment of the present invention and are not meant to be limitations upon the practice thereof, as numerous variations will occur to persons of skill in the art.

I claim:

1. An electrical connector for releasably maintaining a plurality of terminals in electrical contact with respective mating terminals of a mating connector and including detachable retaining means securing the terminals within the electrical connector and a locking member biased to a first locked condition, wherein the locking member secures the electrical connector in mating contact with the mating connector, and movable to a second unlocked condition by applying pressure to a surface of the locking member, characterized in that:

a latch member is connected to the retaining means and is movable with respect thereto between a first latched position wherein it inhibits application of said pressure to the surface of the locking means and a second unlatched position wherein it does not appreciably inhibit movement of the locking member.

2. An electrical connector according to claim 1 wherein the latch member is connected to the retaining means by a hinge permitting movement between the latched position and the unlatched position.

3. An electrical connector according to claim 2 wherein the latch member, the hinge, and the retaining means are formed as an integral unit. position wherein it does not appreciably inhibit movement of the locking member.

4. An electrical connector according to claim 1 wherein the locking member when in the locked condition is spaced apart from a surface of the connector and is moved to the unlocked condition by moving it toward the connector surface, and the latch member further includes blocking means which is interposed between the locking member and the connector surface when the latch member is in the latch position.

5. An electrical connector for detachable engagement with a mating connector, comprising:

a body for enclosing a plurality of terminals and holding the terminals in spaced relationship with one another;

a terminal retainer detachably connected to the body for securing the terminals inside of the body; and a locking member connected to the body to be movable between a first locked condition wherein the locking member engages mating locking means on the mating connector and a second unlocked condition;

a latch member connected to the terminal retainer and movable between a first latched position wherein it inhibits movement of the locking member to the unlocked condition and a second unlatched position wherein it does not appreciably inhibit movement of the locking member, the latch member having guard means which in the latched position obstructs contact with the locking member at a location on the locking member at which the application of force to the locking member tends to move the locking member toward the unlocked condition.

6. An electrical connector according to claim 5 wherein the locking member in its locked condition is spaced from a surface of the body and is moved toward the surface to move it to the unlocked condition, and the latch member further includes blocking means which in the latched position is interposed between the body surface and the locking member to inhibit movement of the locking member toward the body surface.

7. An electrical connector according to claim 5 further comprising first and second side guards extending from the body to be in proximity with the locking member and inhibit contact therewith, the latch member and at least one of the side guards being adapted for releasable engagement with one another to hold the latch member in the latched position.

8. A terminal retainer for securing a plurality of terminals within an electrical connector having locking means biased to a first locked condition wherein the locking means holds the electrical connector in engagement with a mating connector and movable to a second unlocked condition, the terminal retainer having a latch connected thereto for movement between a first latched position wherein the latch inhibits movement of the locking means to the unlocked condition and a second unlatched position wherein the latch does not appreciably inhibit movement of the locking means, characterized in that:

the latch includes guard means which in the latched position obstructs contact with the locking means at a location on the locking means at which the application of force to the locking means tends to move the locking means toward the unlocked condition.

9. A terminal retainer according to claim 8 wherein the latch is connected to the terminal retainer by a hinge permitting movement of the latch between the latched position and the unlatched position.

10. A terminal retainer according to claim 8 wherein the latch further includes blocking means which in the latched position is positioned to obstruct movement of the locking means toward the locked condition.

11. A terminal retainer according to claim 8 wherein the latch further includes detent means releasably engagable with cooperating detent means on the connector to hold the latch in the latched position.

12. An electrical connector for detachable engagement with a mating connector, comprising:

a body for enclosing a plurality of terminals and holding the terminals in spaced relationship with one another;

a locking arm connected to the body and having a free end biased to a first condition wherein the free end is spaced from an outer surface of the body and movable to a second condition wherein the free end is closer to the surface than in the first condition, the locking arm in the first condition engaged with mating locking means on the mating connector and in the second condition disengaged from the mating locking means;

side guard means extending from the outer surface of the body to be in proximity with the free end of the locking arm to obstruct contact therewith, said side guard means having tab holes formed therein;

a terminal retainer detachably connected to the body for securing the terminals inside of the body; and a latch member connected to the terminal retainer by a living hinge and movable between a first latched position wherein blocking means is inserted between the free end of the locking arm and the surface of the body to inhibit movement of the locking arm to the second condition and a second unlatched position wherein it does not appreciably inhibit movement of the locking arm, the latch member having wings with detent tabs for being received in the tab holes of the side guard means, whereby the latch member when in the latched position is in detented engagement with the side guard means.

13. An electrical connector for detachable engagement with a mating connector, comprising:

a body for enclosing a plurality of terminals and holding the terminals in spaced relationship with one another;

a locking arm connected to the body and having a free end biased to a first condition wherein the free end is spaced from an outer surface of the body and movable to a second condition wherein the free end is closer to the surface than in the first condition, the locking arm in the first condition engaged with mating locking means on the mating connector and in the second condition disengaged from the mating locking means;

side guard means extending from the outer surface of the body to be in proximity with the free end of the locking arm to obstruct contact therewith;

a terminal retainer detachably connected to the body for securing the terminals inside of the body; and a latch member connected to the terminal retainer by a living hinge and movable between a first latched position wherein a top guard obstructs contact with the free end of the locking arm at a location on the locking arm at which the application of force to the locking arm tends to move the locking arm toward the second condition and a second unlatched position wherein the top guard does not appreciably obstruct contact with the locking arm, the latch member when in the latched position being in detented engagement with the side guards means.

* * * * *